US005169065A

United States Patent [19]

Bloch

[11] Patent Number: 5,169,065

[45] Date of Patent: Dec. 8, 1992

[54] METHOD AND APPARATUS FOR WATER JET CUTTING INCLUDING IMPROVED NOZZLE

[75] Inventor: Christopher J. Bloch, Kingwood, Tex.

[73] Assignee: Naylor Industrial Services, Houston, Tex.

[21] Appl. No.: 539,079

[22] Filed: Jun. 15, 1990

[51] Int. Cl.[5] ..... B05B 1/02

[52] U.S. Cl. ..... 239/11; 239/590.3; 239/590.5

[58] Field of Search ..... 239/590, 590.3, 590.5, 239/461, 462, 11, 545, 543, 544, 433

[56] References Cited

U.S. PATENT DOCUMENTS

| | | | |
|---|---|---|---|
| 40,847 | 12/1863 | Macy et al. | 239/461 |
| 2,054,964 | 9/1936 | Barker | 239/461 |
| 2,321,017 | 6/1943 | De La Calle | 239/590.3 |
| 3,799,441 | 3/1974 | Delmer | 239/590 |
| 4,119,276 | 10/1978 | Nelson | 239/590.3 |
| 4,501,501 | 2/1985 | Edwards | 138/42 |

*Primary Examiner*—Andres Kashnikow
*Assistant Examiner*—Christopher G. Trainor
*Attorney, Agent, or Firm*—Gunn, Lee & Miller

[57] ABSTRACT

The present disclosure is a nozzle which is comprised of an inlet, an outlet, and an elongate cylindrical housing closed by heads or covers. Within the housing there is an elongate chamber means. Multiple plates extend transversely across the chamber means and are drilled with a number of holes to provide an adequate cross sectional area for a water flow or fluid flow through the chamber. There is an additional transverse plate with holes therein. A number of flexible bendable nylon strings are positioned so that the strings have ends, and the strings are positioned so that the ends are directed toward the outlet. Fluid flow is improved by reduction from highly turbulent flow to laminar flow to string line flow.

14 Claims, 1 Drawing Sheet

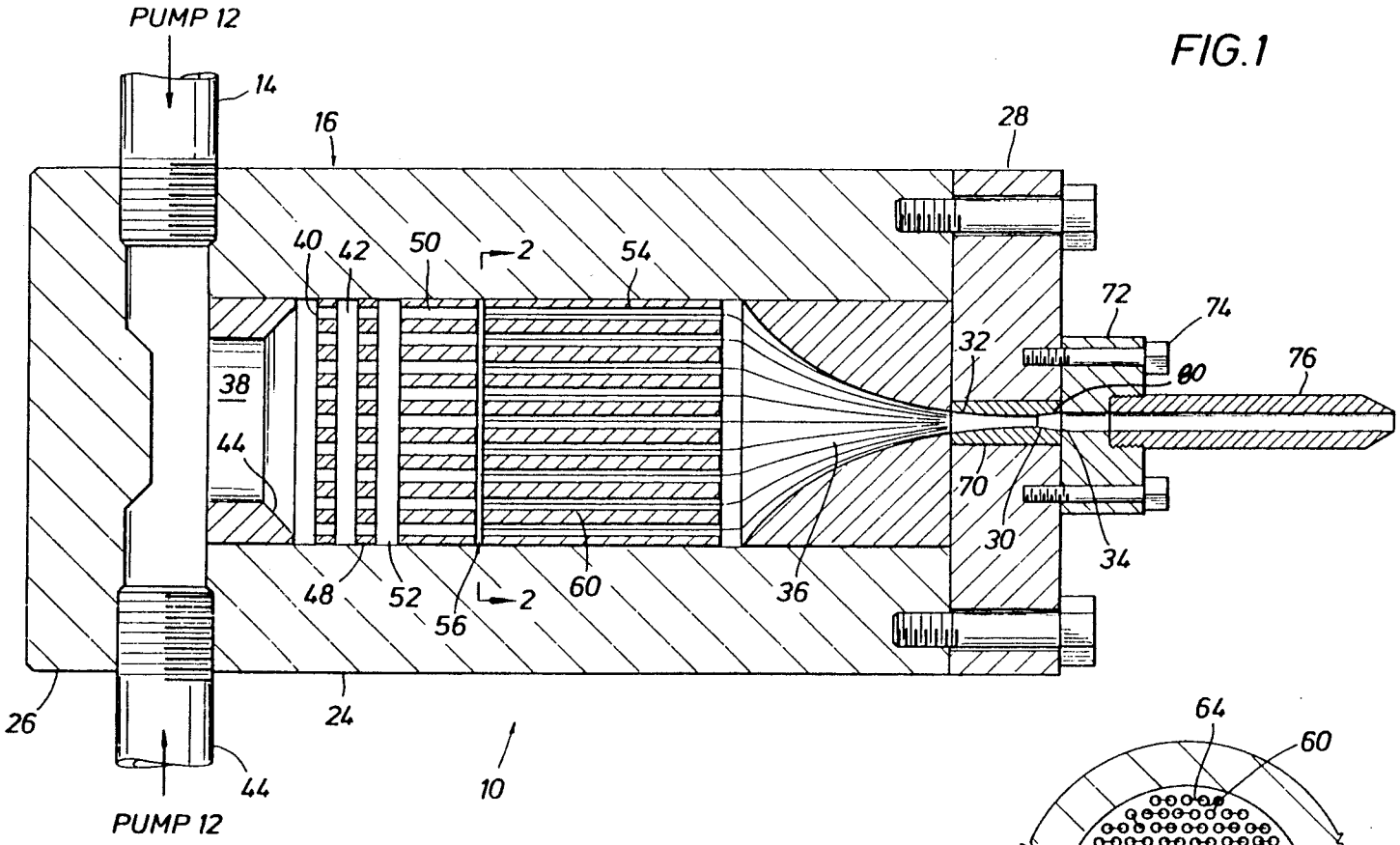
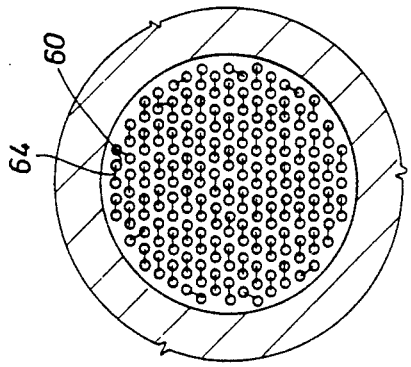
FIG.2

METHOD AND APPARATUS FOR WATER JET CUTTING INCLUDING IMPROVED NOZZLE

BACKGROUND OF THE DISCLOSURE

The present disclosure is directed to an improved water blasting system, and in particular a water blast system capable of providing more narrow or focused streams of water in a water blast apparatus. This is accomplished with an improved nozzle construction. The present disclosure is directed to an improved water blasting system, and in particualr a water blast system capable of providing a more narrow cohesive stream of water in a water blast jet. This is accomplished with a combination of improved constructions including a pre-nozzle assembly, the nozzle orifice and a post-nozzle assembly. These and many other features will be set forth in the context of the water blast system described below.

Water blasting can be used for surface cleaning, or product cutting. Surface cleaning is exemplified by the problem of removing accumulated slag collected on the wall of a furnace. In this representative problem, a coating of furnace generated debris such as fly ash, cinders, silica, perhaps with metal constituents, will collect on the walls of the furnace. Similar accumulations can be observed in practically any processing system where the materials undergo processing confined in a furnace, reaction vessel, tower and the like. The accumulation of material inevitably reduces the efficiency. To restore the furnace or other equipment to an original, like new condition, the surface must be cleaned, and in some instances, this requires removal of materials which are almost as hard as the supporting surface, referring to the furnace, pressure vessel or tower which is coated with the undesirable material.

There is a similar removal problem which involves water blasting to remove a surface coating. For instance, a surface might be coated with paint, veneer, ceramic, refractory or the like, all intentionally placed thereon. Ultimately, the surface requires refurbishing or refinishing and to accomplish that replacement, the surface must be cleaned until clean metal shows, that is, the coating must be completely removed to uncover the supporting structural member.

Another common application of water blasting is the partial removal and/or demolition of concrete or other composite materials from roadway, parking structures, and/or runways, dams, locks, buildings and other similar concrete structures. A representative example of this problem is the requirement to remove weak and spalling concrete from piers supporting an elevated roadway. The concrete of the surface of the piers will deteriorate due to salt induced corrosion of the reinforcing rebar. To repair the piers, it is necessary to remove weakened concrete from above the corroded rebar. It is also desirable to remove additional concrete from behind the rebar to provide newly applied concrete with firm anchoring to the existing structure. At the same time, it is desirable to remove all rust and corrosion from the rebar surfaces. Water blasting is sometimes used for this task. In other circumstances, it may become necessary to remove concrete, stone or other hard material surfaces for the purposes of demolition, removal or modification. High pressure water blasting has application to such requirements. It has been discovered that typical road surfaces exposed to salt for deicing have an aging problem which is best handled by removal of the top few centimeters of roadway. For instance, in northern regions, rock salt is used to melt ice which accumulates on roadways, bridges, runways for aircraft, and the like. Small fissures in the concrete become saturated with the salt which ultimately attacks the integrity of the structure, thereby requiring periodic replacement. In a runway which is perhaps fifty centimeters thick, it is not uncommon to remove the top ten centimeters of the surface. Indeed, a desirable technique is to remove the top portion and expose the underlying rebars. Typically, the salt water penetration into the fissures will ultimately attack the rebars, forming a rust coating thereon and resulting in severe damage to the concrete structure. A loss of strength may also be noted because the rebars are materially weakened. New cement is poured over the surface to restore the thickness to the initial or desired thickness where the newly poured cement becomes an integral part of the structure. Bonding between the new and old concrete is important, and bonding with the rebars is likewise important. In this procedure, it is necessary to remove the top layer of the concrete, expose an interface which is irregular and suitable for adherence, clean the rust or other materials from the rebars to expose them to bright metal, and subsequently to pour the new cement in place.

In the representative cases described above and others too numerous to mention, current water blasting techniques suffer from several drawbacks such as (1) poor mechanical efficiency; (2) relatively short effective distance from the nozzle; (3) inability to cut or remove foulants, coatings, etc. at reasonable pressures, and; (4) slow work rates.

Numerous technologies have been adopted to address these shortcomings and include:

1. Addition of abrasive to the water blast jet.
2. Addition of polymers or other viscosity modifiers.
3. Use of pulsating nozzles.
4. Use of higher water pressures.

Addition of abrasives increases the aggressiveness of the water jet; however, the added expense of the abrasive and the additional need to clean up the spent abrasive must be considered. In addition, abrasives added to water jets often become excessively erosive causing damage to nozzle components and the surfaces being cleaned and cutting or otherwise damaging rebars in situations where concrete is to be removed.

Polymer addition has also had some success in limited applications. The increase in water viscosity improves water jet cohesion, however, it suffers due to the cost of the polymer and contamination and disposal problems. Typically these drawbacks outweigh the minor improvement in jet efficiency. The effectiveness of the polymer is often substantially reduced when the polymer chains are sheared under conditions of high shear and turbulence within the nozzle.

Pulsation nozzles which generate short periodic bursts of water also seem to give some increase in mechanical efficiency. Although this technology has received much academic attention, it has achieved only limited commercial acceptance. This technology is relatively expensive to achieve and is subject to mechanical wear of nozzle parts due to cavitation.

Use of higher pressures has had the most commercial success. Water at pressures of 1,380 to 2,400 bar has improved mechanical efficiencies and work rates without addition of contaminants. This technology has not, however, increased effective working distance appreciably and the costs associated with the purchase, operation and maintenance of 1,380 to 2,400 bar equipment is high.

The present disclosure is directed to an improved distribution system including a nozzle and mounting mechanism for the nozzle as will be set forth. An entire system is disclosed. Focusing for the moment on the nozzle, a typical application requires a strong structure at the nozzle having thick side walls, a relatively large chamber within the nozzle and an orifice attached to the nozzle for delivery of water flow out of the nozzle chamber. Moreover, this nozzle delivers a more narrow stream which cohesively stays focused for a greater distance. There is a tendency for the stream to change from a narrow, focused, precisely shaped stream to a divergent scatter of droplets farther from the nozzle. This can be illustrated at very low pressures by placing a nozzle on a garden hose. Where the water emerges from the nozzle, it is a cylinder of water. Where the stream is projected perhaps several meters through space, it breaks into divergent large droplets. This results from the interaction of the pump pressure, nozzle dynamics, surface tension of the water and inertial and viscous fluid forces and air entrainment in the stream. The distance that a cohesive stream may be directed in space is normally given in multiples of nozzle diameter. Typically, these interacting terms significantly reduce jet cohesion of the stream before it is projected a distance more than about 100 times the nozzle diameter.

The present disclosure incorporates a plurality of aligned holes in a plate or tubes within the nozzle construction upstream of the orifice. In addition to that, this disclosure utilizes a plurality of flexible fibers deployed between the flow straighteners just mentioned and the orifice. Ordinarily, the flow currents within the chamber of a nozzle immediately upstream the orifice are turbulent. As turbulence is reduced, the stream changes to streamline flow. This appears to reduce the required power to obtain the necessary pressure and flow rate. One theory of operation of the present structure contemplates that the flow is so controlled that it is not turbulent, and is in a region which is sometimes called streamlined flow. This further improves stream definition, meaning the stream has a narrow diameter at a greater distance from the orifice and delays along the stream the tendency of the stream to entrain air and break into droplets as a result of the fluid surface tension.

SUMMARY OF THE INVENTION

It is, therefore, an object of the present invention to provide a water blast jet with significantly improved mechanical efficiency, faster work rates, ability to cut harder materials at lower pressures, low wear rates and longer effective jetting distances.

The above and other objects of the present inventions will become apparent from the drawings, the description given herein, and the appended claims.

In one embodiment of the present invention, water is delivered from a pressure generating displacement pump through a conduit to a flow splitting block. The conduit is pipe or often flexible hose with a high pressure rating. Typically such conduits have small internal cross sections necessitated by structural requirements to contain the high pressures. The flow splitting block divides the flow more or less equally. The divided flow is then directed to a pre-nozzle construction of greatly enlarged internal cross section. The divided flows enter the pre-nozzle block in opposition to each other. This is done to spoil the velocity generated by the flow through the constricted cross section of the delivery conduits. A plurality of perforated flow distributors are aligned within the nozzle block entrance to insure further reduction of the water velocity. This distributed flow then transverses a construction of multiple small diameter aligned flow passages (streamline flow generating section). The diameter and length of these passages are designed to reduce internal fluid motion on axis perpendicular to the primary direction of flow. This condition is typically described as streamline flow as opposed to the condition of highly turbulent flow that existed in the transfer conduits.

The internal effective wetted diameter of the multiple aligned small diameter flow passages is further reduced by the deployment of a plurality of very small diameter highly flexible fibers over the entire length of the streamline flow generating section. The combined effect is to generate a flow environment where viscous forces become more significant and internal inertial forces are generally reduced within the water stream. The length of the streamline flow generating section is sufficient to effectively dampen residual turbulence generated in the delivery conduits.

The small diameter flexible fibers extend beyond the laminar flow generating section into a section of rapidly reducing cross sectional area. The fiber concentration and length are designed to maintain a small effective wetted diameter as the flow is accelerated to the nozzle throat. The contraction to the nozzle throat is rapid as it is important to not allow sufficient time for the water to again become turbulent. The radius of the contraction and the presence of the flexible fibers align the water entering the nozzle throat to minimize velocity vectors perpendicular to the nozzle alignment and to inhibit the formation of flow eddies and vortices as the water is accelerated.

Once the critical nozzle diameter is reached, the flow cross section is again increased to allow for the slight decompression of the high pressure water. At high pressures, the water is indeed somewhat compressible. The contracting-expanding nozzle allows for the relief of these compressive forces in the desired direction of flow, again reducing velocity vectors perpendicular to the desired jet axis.

An additional embodiment includes the grinding of a microscopic groove on the throat of the expanding surface of the nozzle. The discontinuity of the nozzle surface represented by this microscopic groove provides a point of nucleation for the water jet to break from the surface of the nozzle. This feature reduces the magnitude of surface disruptions due to surface tensional effects.

Another embodiment of this disclosure in the provision of a vapor shroud around the free jet as the water leaves the nozzle tip. The clearance between the internal diameter of the shroud and the diameter of the free jet is sufficiently small to effectively generate a vacuum in this space due to the educting effect of the high velocity water jet. This annular space allows for the vaporization of some of the water from the surface of the jet with the effect that at the terminus of the shroud, the free water jet is surrounded by a high velocity stream of water vapor. Within the length of the shroud, the unstable surface of the jet is effectively shielded from air which would otherwise interact with the jet surface causing deceleration and droplet formation. The tip of the shroud is configured to minimize the angle of impingement of the surrounding air on the high velocity stream of water vapor and the free water jet.

The present invention is substantially different for all current technologies as it is specifically designed to take advantage of the unique conditions present in a high pressure nozzle and the resulting high velocity free jet which cause water to behave for very short periods of time as a non-Newtonian fluid.

The conditions are derived from the fact that the elastic response time of water is related to the speed of sound in water which is a function of molecular spacing, molecule mass and the cohesive attractions between water molecules and between water molecules and surfaces. Physical laws dictate that when forces are applied to a fluid the fluid cannot respond elastically faster than the speed of sound of that fluid. It is one purpose of this invention to make the water flow in a more cohesive condition and to dampen and substantially reduce internal water eddy velocities which will decrease jet turbulence which in turn will result in less rapid rates of air co-mingling and droplet formation.

When the streamlined water is extruded and thus accelerated to considerable velocity in a very short period of time while minimizing external forces and the onset of turbulence, the time necessary for the water to lose its cohesive condition is sufficient to allow the high velocity jet to travel significant distances before it mixes with air and disintegrates into a spray of small droplets.

The present invention is designed to dampen and minimize internal turbulent forces in the water flow. This is done by means of the flow splitter, the opposing flow entrance, the greatly enlarged cross section which reduces velocities and the flow distributors. The flow is then given time to become highly cohesive in the streamline flow generating section. The surfaces of the flexible fibers further reduce the wetted diameter and accentuate viscous forces relative to inertial forces. The water is then accelerated in a rapid but smooth transition within the fiber filled contraction section.

The residence time of the water from the moment it leaves the fiber packed contraction zone to the critical nozzle diameter is typically less than 0.002 seconds. At low pressures the velocity may be a few hundred feet per second; at very high pressures the velocity will be greater, often approaching 2,000 feet per second. By starting with a highly cohesive condition and minimizing disturbing forces in the contraction zone, the nozzle, the point of water surface disengagement and the point of the water jet/air interface, a significant amount of the cohesive energy of the water will be conserved and thereafter remain available to be transferred to the surface being impacted.

The foregoing is generally directed to the present structure but the details of that structure set forth in the description found below in conjunction with the attached drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a portion of a nozzle showing internal tubes within the nozzle which operate in conjunction with flexible fibers to thereby control the flow of a fluid within the nozzle to the orifice so that the high pressure stream discharged thereby is a more narrowly defined focused stream; and FIG. 2 is sectional view showing part of the flow straightening devices in the nozzle.

DETAILED DESCRIPTION OF THE PREFERRED EMBODIMENT

Attention is directed to FIG. 1 of the drawings which represents in simplified fashion a pump cooperating with a nozzle 10 in accordance with the present disclosure. The entire system of FIG. 1 will be denoted as a water blast system. It can be used either for surface cleaning as discussed above or for blasting various materials. In either case, the nozzle 10 of FIG. 1 is installed with other equipment which is not described in detail to support the nozzle 10; it may be hand supported. In any event, beginning with FIG. 1, a supply of water is connected with a pump 12 which delivers the water flow through a flow line 14. Duplicate lines 14 can be conveniently connected to the pump through a flow splitting manifold. That flow is delivered to a housing 16, through the duplicate and opposing inlets and pump pressure forces the water through the nozzle 10 as the stream of water. Duplicate inlet lines diametrically connected as shown dampen velocity forces from the flow lines. Moreover, the pump inlet line is best connected as flow is deflected at an angle on introduction.

The nozzle 10 is connected with the flow lines at inlet 14. The nozzle housing is constructed with a surrounding cylindrical shell 24 and the shell is closed at both ends by suitable circular heads or plates 26 and 28. The head plates 26 and 28 are placed on both ends of the cylindrical shell or housing 24. The line 14 connected to the nozzle inlet delivers substantial water volume through a fairly large hose. The pump is a pump capable of raising the pressure in the nozzle to the requisite elevated pressure, for example, 1,000 bar.

One end of the cylindrical shell 24 supports an orifice 30. The orifice 30 has a water inlet at 32 and an external water outlet 34. The orifice directs the fluid from the chamber 36 in an elongate tapered conic shape, and this shape is imparted to the fluid stream as a result of the streamline flow which occurs in the chamber 38 upstream. The chamber 38 has a specified length and diameter. A central portion thereof supports a removable assembly of four specific hole or passage defining members. The inserts are deployed so that the water introduced at left end or the inlet, whether turbulent or not, is delivered to the interior of the chamber 38 and flows through the inserts to be described.

The chamber 38 supports inserts having the following thicknesses and diameters. Each of the four inserts is preferably formed by drilling holes in a circular plate. The numeral 40 identifies a first insert. This is a plate of full width, perhaps around 1 cm in thickness and having a diameter of 10 to 15 cm to fill the circular chamber 38. The plate 40 therefore typically has a diameter of 12 cm in a typically nozzle construction. The plate is drilled with a number of holes, typically 200 or more holes. Alternately, the insert plate 40 can be formed of a nest of tubes which are adhesive joined together which effectively form a circular plate having a set of similar passages through it. The total cross sectional area through the holes of the plate 40 is sufficient to provide adequate fluid flow through the nozzle. There is a space or gap at 42 where there is no insert. This is a region where fluid flow has been straightened somewhat by the plate 40. The fluid flow thus flows into the chamber 38, and is introduced typically in a very turbulent flow where the chamber 38 is faired by the expanding surface at 44. The fluid flow turbulently fills the entire cross section, and turbulence is reduced by the insert 40 made with an adequate number of holes in it where the holes have an aggregate cross sectional area to handle maximum flow through the device. The chamber cross section is about 100 to 1,000 times greater than the cross section of the narrowest part of the orifice. The aggregate cross section of the holes in the insert 44 is typically 60 to 800 times greater than the orifice cross section area. The greatly enlarged cross section reduces bulk fluid velocities and increases fluid residence time.

After the space 42, there is another insert plate 48. The plate 48 is similar to the plate 40. The holes in this plate serve to further straighten the flow, thereby reducing turbulence and insuring uniform distribution of the fluid. There is another space 52 beyond that and another insert 50 is positioned downstream so that the inserts 48 and 50 are separated by the space 52. The insert 50 is identical in external diameter to the inserts 40 and 48. It preferably has the same number of holes to provide the same cross sectional flow area. The insert 50 however is much thicker and the holes in it are much longer. The insert 50 terminates at a planar face on both ends. At one end, the insert 50 is positioned immediately adjacent to another insert 54. The two inserts leave a very small gap therebetween, the gap being identified by the numeral 56.

The gap 56 is sized for a particular purpose. The gap 56 is defined by opposing faces of the metal inserts 50 and 54. The inserts are preferably drilled with common patterns in the two inserts and they are positioned so that the holes are aligned. A small pin (not shown) is inserted through a small hole positioned in each insert to assist alignment. In other words, a particular hole or passage 60 shown in the drawings extends through both the insert 50 and the insert 54. These two are aligned so that the hole or passage 60 is formed of two segments interrupted only slightly by the gap 56. The gap 56 is quite small and in the preferred embodiment is about 0.075 mm. This gap is slightly smaller than the diameter of certain strings. Strings are cut to length and folded in a U-shaped pattern so that respective left and right legs of the strings extend through adjacent holes such as the passage 60, see FIG. 2 of the drawings. More particularly, an individual string 64 is folded in a U-shaped and positioned with one leg in the hole or passage 60, and another leg portion thereof in an adjacent hole. The string is typically formed of pliable, small diameter monofilament fishing line, and is very flexible. Nylon string is typically used. The diameter of the string is relatively important. The string diameter is slightly greater than the gap 56. Since the gap is 0.075 mm, the string is preferably about 0.1 mm in diameter. This assures that the string is clamped when the inserts 50 and 54 are assembled to define a gap 56 therebetween. Moreover, this positions two ends of the string in the insert 54, although as noted, the two ends of the string are located in different passages. In the preferred embodiment, utilizing approximately 211 holes in the insert 54, there are preferably about six or more flexible strings or filiment lines deployed in each hole. As many as twenty filaments per hole have been used successfully. This requires that all of the strings be folded in a U-shape and positioned so that the center of the string as shown in FIG. 2 is captured in the gap 56. The gap is reduced to less than the thread diameter, thereby clamping the threads. A suitable adhesive can be applied to the assembly to further secure the filaments.

Assume for purposes of description that the insert 54 has a length of approximately 5 to 20 cm. The strings are longer than this so that both ends of all of the strings hang into the chamber 36. Recall that the chamber 36 is a tapered flow region. Assuming that 211 holes are used in the plate making up the insert 54, and further assuming that each of the 211 holes has six to twenty string ends therein, this positions over 1,200 to 4,220 string tips in the conic space 36. They all preferably have length sufficient that all the strings form a tapered slope extending to the orifice 30. Accordingly, the strings in this chamber are trimmed so that they can extend from the insert 54, and when trimmed, they form a tapered shape more or less conforming to the chamber 36 shape shown in FIG. 1. After trimming, the strings then will not bunch up and risk plugging the orifice 30. Accordingly, some of the strings are cut so that they are rather short while other strings are permitted to reach almost to the orifice 30. The strings are collectively (meaning as a group) tapered so that they fit within the tapered chamber 36. More will be said regarding string length and size.

The head plate 28 is constructed with the insert 70 previously mentioned. The insert supports the orifice opening 30 which narrows to a thin diameter at the curvature 32. In one embodiment, the orifice 30 has a diameter of about 3.2 mm and flares out somewhat to a slightly larger diameter of about 3.3 mm. At this point, a small internal encircling groove about 0.025 mm deep is cut into the transition. The flare continues after this groove to a diameter of about 3.6 mm. The insert is clamped in position by a suitable locking collar 72 held in position by a fastener 74. The collar 72 additionally supports an extending shroud 76. Recall that the orifice is about 3.2 mm in the described embodiment. The shroud 76 encompasses the passage for the high velocity jet of water. The shroud however is slightly larger than the diameter of the orifice. It should be noted that the orifice diameter connects with a slightly enlarging taper 34; the diameter is in the vicinity of about 3.6 mm. At this location, the water tends to expand. While it is true that water is incompressible in most circumstances, the system operates at sufficient pressure on the water that there will be a modest expansion, and the outward taper from the orifice 30 to the diameter at 34 is sufficient to permit this modest expansion to occur. This improves the velocity of the jet. The groove at 80 is positioned to provide a point for surface formation of the jet. Moreover, the shroud 76 has an internal diameter of about 4.0 mm so that the jet of water is able to travel at high speed, evacuating the interior of the shroud, and thereby surrounding the jet fluid with a surrounding partial vacuum region.

The foregoing describes the structure of the present nozzle. However, it should be considered from a point of view of what happens to the water. Water is introduced at a high pressure, for instance 1,000 bar in particular example. It is highly turbulent in the chamber at the left hand in the end of FIG. 1. This highly turbulent flow of water passes through the insert 40 where the turbulence is significantly reduced as proven by the Reynolds number which is markedly reduced. The fluid flow then passes through the open region at 42 and into the passages of plate 48, the next straightening holes and again, velocity and turbulence are reduced and the flow at this juncture is quieted. The flow then passes through the insert 50 and the last insert 54. These two inserts further reduce turbulence as evidenced by declining Reynolds number. Moreover, because the diameter of the nozzle is quite large in this region compared to the diameter of the orifice outlet, the velocity is reduced and the residence time has increased. An increase in fluid residence time markedly calms the flow so it is more easily becomes streamline flow instead of turbulent flow, and indeed, streamline flow is ultimately reached along the streamline flow generating section 54.

Omission of the fibers or strings provides a nozzle with a certain performance level. The addition of the nozzle filaments further enhances performance as evidenced by reduced pumping power to obtain a fixed outlet pressure in the stream of water. Another way to look at it is that the insertion of the strings reduces turbulence. This calming on the turbulent flow experienced within the nozzle helps assure that extremely highly pressure water can be introduced, and yet the energy required for pumping is markedly and radically reduced because the Reynolds numbers is reduced and turbulence is stilled. As one example, this nozzle can reduce the Reynolds number from a typical inlet valve of 100,000 or more to a Reynolds number at the conic region 36 of 10,000 or less; with sufficient rigid lengthwise louvered flow surfaces, this Reynolds number is achieved. Better Reynolds numbers at lower cost are achieved with a set of filaments as taught herein.

Benefits of the fibers ought to be noted. The fibers are preferably deployed across the full width of the chamber 36 and extend through that tapered conic chamber so that fibers engage the fluid in all regions of the chamber. The fibers are highly flexible so that they are easily pulled by reduced pressure into eddy current regions, and by this flexure, occupy those regions preventing such eddies. In other words, the flexible strings prevent the formation of eddy currents, and thereby still any tendency for turbulence. Because of this, streamline flow occurs. Moreover, it is desirable that the strings be deployed in all regions where the water does flow and to this end, they are cut short of the extremely small diameter described in the exemplary embodiment. In larger nozzles, operating at lower pressure and lower bulk velocities, the filament can extend into and through the nozzle. In such larger nozzles, for instance those in the vicinity of about 12 mm or larger, fibers which are as small as 0.1 to about 0.6 mm can easily extend through the smallest opening of the orifice.

The preferred form is monofilament line which is generally treated as cylindrical in cross section. Alternate forms that would be acceptable would be surfaces providing enhanced surface area such as a flat ribbon or the like. It is preferred that the flexible strings be collectively joined at the gap 56 where they are pinched. Accordingly, whether flat or round, they are clamped by the close proximity of the two inserts 50 and 54, or alternately, they are clamped and held in position supplemented by an adhesive applied to the points of intersection such as a solvent or varnish or other material which would coact with the fibers to join them together.

The interaction of the fibers with the nozzle at the orifice ought to be considered. First of all, the fibers reduce turbulence as mentioned above. For that reason, it would be desirable that they extend through the nozzle or orifice and extend into the stream of flowing water beyond. This will assist in cohesively binding the stream into an continuously flowing cylindrical but unsupported stream of water.

The present apparatus is able to emit a nicely shaped stream of water at a very low pressure, say 100 psi or even lower. When the pressure is that low, the throughput of the nozzle assembly is quite slow and turbulence within the nozzle is again substantially nil so that the stream cohesively holds its shape, and the length of the stream before breaking up beyond the nozzle is markedly enhanced should the strings or fibers extend out through the nozzle. However, as the pressure is increased, the flow rate increases, and the loss of velocity of the stream entails loss of definition of the emerging stream so that the smooth cylindrical wall of water beyond the nozzle begins to feather and then entrains air, and the water with the entrained air slows even further. After that, the stream will break up, and there will be a significant loss of velocity and jet cohesion. The shroud which is illustrated in FIG. 1 is spaced slightly from the emerging stream. The flowing water stream in the shroud 76 tends to form a partial vacuum within the shroud so that the vacuum surrounds the first portion of the stream after it emerges from the nozzle. Depending on the vacuum, temperature of the water and other factors, the vacuum will be partially filled with water vapor rather than air. This encircling vacuum region enables the stream to maintain its sharp cylindrical wall definition without feathering. In other words, there is no air immediately adjacent to the water jet which might otherwise be entrained into the flowing water stream. This substantially eliminates the feathering which might otherwise occur. It further enables the cohesion of the water to sustain the cylindrical shape for a longer term and resist the tendency to feather and thereby dissipate energy as the flowing water entrains air. Interestingly, in a work piece which is being cut with this stream, deep cuts can be obtained, where the depth of the cut is aided and assisted by the kerf of the cut. So to speak, a deeper cut is obtained in wood, concrete, and other solids because the previously cut materials defining the point of entry into the solid material serve as a shroud. As will be understood, the extent of this protection is variant depending on numerous scale factors.

Another important factor in the formation of a cylindrical stream and hence the operative range of the stream derives from the smoothness of the orifice. It is preferable that the orifice terminate at 80 with a sharp edge permitting water release from the surrounding metal structure. The orifice is typically made of a hardened material. It is preferably machined so that there is the taper at 32 as shown in FIG. 1, and a sharp edge at the groove 80 before the end of the taper 34. This can be an internal groove cut in the surrounding structure. The groove can be very shallow and can be more in the order of a quarter round groove. In any case, it aids and assists in defining a sharp encircling lip for disengagement of the water as it emerges from the orifice 30.

While the foregoing is directed to the preferred embodiment, the scope thereof by determined by the claims which follow. These claims describe the nozzle capable of operating at high pressures, typically 350 bar or greater, and provides a fluid condition which is substantially streamlined flow.

What is claimed is:

1. A method of directing a stream of water from a high pressure pump through a nozzle comprising the steps of:

(a) delivering a flow of water under high pressure at a specified pressure range into a nozzle chamber for delivery through an orifice of the nozzle;

(b) within the chamber of said nozzle, positioning flexible fibers having fluid engaging surface means interacting with the flowing water so that the flowing water flows toward said orifice thereof; and (c) directing the water flow through the orifice, wherein the water flow toward the orifice extends said flexible fibers toward the orifice.

2. The method of claim 1 wherein said surface means forms straight flow patterns and also flexes.

3. A fluid system for delivery of a stream of water flowing in a system comprising:

(a) a pump;

(b) a fluid line connected to said pump;

(c) a nozzle connected to said fluid line for delivery of the water therefrom at high pressure, wherein the pressure is determined by said pump;

(d) an outlet orifice in said nozzle for directing the stream of water from said orifice toward a desired target;

(e) upstream of said orifice, and in a location exposed to the fluid flow from the pump, flexible interacting surfaces extending within the flowing fluid and directed by the flow toward said orifice so that said surfaces contact and interact with the flowing fluid in a fashion determined in part by the surface tension of the flowing fluid with respect to the surfaces, and further wherein said surface have upstream fixed guide surface portions to direct fluid flow toward said orifice;

(f) said flexible surfaces comprising elongate filaments extending from the interior of said nozzle and extending towards said outlet orifice.

4. The fluid delivery system of claim 3 wherein said interacting surfaces are included within an enclosed chamber having an enlarged cross-sectional area which reduces the velocity of the fluid flow so that the Reynolds number of the flowing water is reduced to enable streamline fluid flow from said outlet orifice.

5. The fluid delivery system of claim 3 wherein said fluid line connects from said pump to said nozzle at a pair of oppositely positioned and opposing fluid inlets to introduce two fluid streams into said nozzle which introduction calms velocity related currents and enables fluid to flow through said nozzle toward said orifice.

6. The apparatus of claim 3 including an internal groove formed down stream of said nozzle for engaging the stream of water flowing through said orifice and also providing an edge for water disengagement from the surrounding structure of said nozzle.

7. The apparatus of claim 6 including an elongate hollow shroud extending from said nozzle along the path of flow of the stream of water.

8. The apparatus of claim 3 including means for shaping the surface of the stream of water after passing through said nozzle and outlet orifice.

9. A nozzle for delivery of a stream of water at high pressure, comprising:

(a) a housing having (1) an inlet at one end for receiving water, and (2) an outlet at the opposite end for delivery of the stream of high pressure water;

(b) an outlet orifice at said outlet which is (1) sized to deliver a required water flow rate, (2) centered on an outlet axis, (3) open to flow along said axis, and (4) extends along said axis to direct water beyond said orifice;

(c) chamber means of enlarged cross section within said housing between said inlet and outlet to direct water into said outlet orifice;

(d) means in said chamber means having surfaces thereon in contact with the water flowing in said chamber means toward said orifice to direct flow through said orifice and also generate streamline flow in the flowing water so that the water flowing through said orifice forms an axially directed stream; and (e) first and second plates having a plurality of passages therein positioned within said chamber means to define a gap therebetween wherein said gap has a specified width, and further wherein said means having surfaces thereon comprises flexible fibers positioned in said gap and having a diameter equal to or greater than the gap between said first and second plates, and further wherein said fibers have ends which extend toward the outlet of said housing and said fibers are free to flex with water flow.

10. The apparatus of claim 9 including third and fourth plates having a plurality of passages positioned with said first and second plates in said chamber means;

(a) said first plate being positioned nearest said outlet;

(b) said second plate being positioned upstream in space from said first plate;

(c) said third plate being positioned upstream of said second plate, and wherein said plurality of passages in all of said plates are sufficient to carry fluid flow from the inlet to the outlet of said housing.

11. A fluid system for delivery of a stream of water flowing in a system comprising:

(a) a pump;

(b) a fluid line connected to said pump;

(c) a nozzle connected to said fluid line for delivery of water therefrom at high pressure, wherein the pressure is determined by said pump;

(d) an outlet orifice in said nozzle for directing the stream of water from said orifice toward a desired target; and (e) upstream of said orifice, and in a location exposed to the fluid flow from the pump flexible interacting surfaces extending within the flowing fluid and directed by the flow toward said orifice so that said surfaces contact and interact with the flowing fluid in a fashion determined in part by the surface tensions of the flowing liquid with respect to the surfaces and further wherein said surfaces have upstream fixed surface portions to direct the fluid flow toward said orifice wherein said fluid line connects from said pump to said nozzle at a pair of oppositely positioned and opposing fluid inlets to introduce two fluid streams into said nozzle which introduction calms velocity related currents and enables the fluid to flow through said nozzle toward said orifice.

12. A nozzle for high pressure water, comprising (a) a housing having (1) an inlet at one end for receiving the water (2) an outlet at the opposite end for delivery of the high pressure water wherein the outlet includes an orifice which forms a water stream;

(b) chamber means of enlarged cross section within said housing between said inlet and outlet to enable the water to flow to said outlet;

(c) means positioned in said chamber means to form said multiple water flow passages extending from said inlet to said outlet wherein said passages collectively define a cross sectional area greater than said outlet and said passages are arranged to reduce water flow turbulence; and (d) multiple flexible fibers extending within said passages toward said outlet to contact the flowing water to reduce turbulence.

13. The apparatus of claim 12 wherein said fibers are multiple parallel strings having a free end extending toward said outlet.

14. The apparatus of claim 12 wherein said passages are parallel circular passages ending upstream of said outlet.

* * * * *